US009394591B2

(12) United States Patent
Deodeshmukh et al.

(10) Patent No.: US 9,394,591 B2
(45) **Date of Patent: *Jul. 19, 2016**

(54) ACID AND ALKALI RESISTANT NICKEL-CHROMIUM-MOLYBDENUM-COPPER ALLOYS

(71) Applicant: Haynes International, Inc., Kokomo, IN (US)

(72) Inventors: Vinay P. Deodeshmukh, Kokomo, IN (US); Nacera Sabrina Meck, Spring, TX (US); Paul Crook, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 501 days.

This patent is subject to a terminal disclaimer.

(21) Appl. No.: 13/719,369

(22) Filed: Dec. 19, 2012

(65) Prior Publication Data

US 2013/0287623 A1 Oct. 31, 2013

Related U.S. Application Data

(60) Provisional application No. 61/640,096, filed on Apr. 30, 2012.

(51) Int. Cl.
*C22C 19/05* (2006.01)
*C22F 1/10* (2006.01)

(52) U.S. Cl.
CPC ..... *C22C 19/055* (2013.01); *C22C 19/053* (2013.01); *C22F 1/10* (2013.01)

(58) Field of Classification Search
CPC ..... C22C 19/05; C22C 19/03
See application file for complete search history.

(56) References Cited

U.S. PATENT DOCUMENTS

| | | | | |
|---|---|---|---|---|
| 3,844,774 | A | 10/1974 | Culling | |
| 4,836,985 | A | 6/1989 | Culling | |
| 6,280,540 | B1 | 8/2001 | Crook | |
| 6,623,869 | B1 | 9/2003 | Nishiyama et al. | |
| 6,740,291 | B2 | 5/2004 | Crook | |
| 6,764,646 | B2 | 7/2004 | Crook et al. | |
| 2008/0279716 | A1 | 11/2008 | Nishiyama et al. | |
| 2010/0034690 | A1 | 2/2010 | Nishiyama et al. | |
| 2010/0313988 | A1* | 12/2010 | Matsuo | 138/177 |
| 2011/0236252 | A1 | 9/2011 | Ueyama et al. | |

FOREIGN PATENT DOCUMENTS

| | | | |
|---|---|---|---|
| EP | 1717330 | A1 * | 11/2006 |
| EP | 2256220 | A1 | 12/2010 |
| WO | 2011034100 | A1 | 3/2011 |

OTHER PUBLICATIONS

European Search Report for EP 13 00 2282 dated Jul. 18, 2013.
United Kingdom Intellectual Property Office Search report Under Section 17 dated Aug. 8, 2013.

* cited by examiner

*Primary Examiner* — Jessee Roe
(74) *Attorney, Agent, or Firm* — Buchanan Ingersoll & Rooney PC

(57) ABSTRACT

A nickel-chromium-molybdenum-copper alloy resistant to 70% sulfuric acid at 93° C. and 50% sodium hydroxide at 121° C. for acid and alkali neutralization in the field of waste management; the alloy contains, in weight percent, 27 to 33 chromium, 4.9 to 7.8 molybdenum, greater than 3.1 but no more than 6.0 copper, up to 3.0 iron, 0.3 to 1.0 manganese, 0.1 to 0.5 aluminum, 0.1 to 0.8 silicon, 0.01 to 0.11 carbon, up to 0.13 nitrogen, up to 0.05 magnesium, up to 0.05 rare earth elements, with a balance of nickel and impurities.

3 Claims, No Drawings

ACID AND ALKALI RESISTANT NICKEL-CHROMIUM-MOLYBDENUM-COPPER ALLOYS

CROSS REFERENCE TO RELATED APPLICATION

This application claims the benefit of U.S. Provisional Application No. 61/640,096 filed Apr. 30, 2012.

FIELD OF INVENTION

This invention relates generally to non-ferrous alloy compositions, and more specifically to nickel-chromium-molybdenum-copper alloys that provide a useful combination of resistance to 70% sulfuric acid at 93° C. and resistance to 50% sodium hydroxide at 121° C.

BACKGROUND

In the field of waste management, there is a need for metallic materials which resist hot, strong acids and hot, strong caustic alkalis. This is because such chemicals are used to neutralize one another, resulting in more stable and less hazardous compounds. Of the acids used in industry, sulfuric is the most important in terms of the quantities produced. Of the caustic alkalis, sodium hydroxide (caustic soda) is the most commonly used.

Certain nickel alloys are very resistant to strong, hot sulfuric acid. Others are very resistant to hot, strong sodium hydroxide. However, none possesses adequate resistance to both chemicals.

Typically, nickel alloys with high alloy contents are used to resist sulfuric acid and other strong acids, the most resistant being the nickel-molybdenum and nickel-chromium-molybdenum alloys.

On the other hand, pure nickel (UNS N02200/Alloy 200) or nickel alloys with low alloy contents are the most resistant to sodium hydroxide. Where higher strength is required, the nickel-copper and nickel-chromium alloys are used. In particular, alloys 400 (Ni—Cu, UNS N04400) and 600 (Ni—Cr, UNS N06600) possess good resistance to corrosion in sodium hydroxide.

During the discovery of the alloys of this invention, two key environments were used, namely 70 wt. % sulfuric acid at 93° C. (200° F.) and 50 wt. % sodium hydroxide at 121° C. (250° F.). 70 wt. % sulfuric acid is well known to be very corrosive to metallic materials, and is the concentration at which the resistance of many materials (including the nickel-copper alloys) breaks down, as a result of changes in the cathodic reaction (from reducing to oxidizing). 50 wt. % sodium hydroxide is the concentration most widely used in industry. A higher temperature was used in the case of sodium hydroxide to increase internal attack (the main form of degradation of nickel alloys in this chemical), hence increase the accuracy of measurements during subsequent cross-sectioning and metallographic examination.

In U.S. Pat. No. 6,764,646 Crook et al. describe nickel-chromium-molybdenum-copper alloys resistant to sulfuric acid and wet process phosphoric acid. These alloys require copper in the range 1.6 to 2.9 wt. %, which is below the levels required for resistance to 70% sulfuric acid at 93° C. and 50% sodium hydroxide at 121° C.

U.S. Pat. No. 6,280,540 to Crook discloses copper-containing, nickel-chromium-molybdenum alloys which have been commercialized as C-2000® alloy and correspond to UNS 06200. These contain higher molybdenum levels and lower chromium levels than in the alloys of this invention and lack the aforementioned corrosion characteristics.

U.S. Pat. No. 6,623,869 to Nishiyama et al. describes nickel-chromium-copper alloys for metal dusting service at high temperatures, the maximum copper contents of which are 3 wt. %. This is below the range required for resistance to 70% sulfuric acid at 93° C. and 50% sodium hydroxide at 121° C. More recent U.S. Patent Application Publications (US 2008/0279716 and US 2010/0034690) by Nishiyama et al. describe additional alloys for resistance to metal dusting and carburization. The alloys of US 2008/0279716 differ from the alloys of this invention in that they have a molybdenum restriction of not more than 3%. The alloys of US 2010/0034690 are in a different class, being iron-based, rather than nickel-based, with a molybdenum content of 2.5% or less.

SUMMARY OF THE INVENTION

The principal object of this invention is to provide alloys, capable of being processed into wrought products (sheets, plates, bars, etc.), which exhibit a useful and elusive combination of resistance to 70% sulfuric acid at 93° C. (200° F.) and resistance to 50% sodium hydroxide at 121° C. (250° F.). These highly desirable properties have been unexpectedly attained using a nickel base, chromium between 27 and 33 wt. %, molybdenum between 4.9 and 7.8 wt. %, and copper greater than 3.1 wt. % and up to 6.0 wt. %.

To enable the removal of oxygen and sulfur during the melting process, such alloys typically contain small quantities of aluminum and manganese (up to about 0.5 and 1.0 wt. %, respectively in the nickel-chromium-molybdenum alloys), and possibly traces of magnesium and the rare earth elements (up to about 0.05 wt. %). In our experiments, aluminum contents of between 0.1 and 0.5 wt. %, and manganese contents between 0.3 and 1.0 wt. %, were found to result in successful alloys.

Iron is the most likely impurity in such alloys, due to contamination from other nickel alloys melted in the same furnaces, and maxima of 2.0 or 3.0 wt. % are typical of those nickel-chromium-molybdenum alloys that do not require an iron addition. In our experiments, iron contents up to 3.0 wt. % were found to be acceptable.

Other metallic impurities are possible in such alloys, due to furnace contamination and impurities in the charge materials. The alloys of this invention should be able to tolerate these impurities at the levels commonly encountered in the nickel-chromium-molybdenum alloys. Also, alloys of such high chromium content cannot be air melted without some pick up of nitrogen. It is usual, therefore, in high chromium nickel alloys to allow up to 0.13 wt. % maximum of this element.

With regard to carbon content, the successful alloys in our experiments contained between 0.01 and 0.11 wt. %. Surprisingly, Alloy G with a carbon content of 0.002 wt. % could not be processed into wrought products. Thus a carbon range of 0.01 to 0.11 wt. % is preferred.

With regard to silicon, a range of 0.1 to 0.8 wt. % is preferred, based on the fact that levels at each end of this range provided satisfactory properties.

DETAILED DESCRIPTION OF THE INVENTION

The discovery of the compositional range defined above involved study of a wide range of nickel-based compositions, of varying chromium, molybdenum, and copper contents. These compositions are presented in Table 1. For comparison, the compositions of the commercial alloys used to resist either 70% sulfuric acid or 50% sodium hydroxide are included in Table 1.

TABLE 1

Compositions of Experimental and Commercial Alloys

| Alloy | Ni | Cr | Mo | Cu | Fe | Mn | Al | Si | C | Other |
|---|---|---|---|---|---|---|---|---|---|---|
| A* | Bal. | 27 | 7.8 | 6.0 | 1.1 | 0.3 | 0.2 | 0.1 | 0.03 | |
| B* | Bal. | 27 | 7.5 | 5.9 | 1.1 | 0.3 | 0.3 | 0.1 | 0.01 | |
| C | Bal. | 28 | 7.3 | 3.1 | 1.1 | 0.3 | 0.3 | 0.1 | 0.01 | |
| D | Bal. | 30 | 8.2 | 2.6 | 0.9 | 0.3 | 0.5 | 0.1 | 0.03 | |
| E* | Bal. | 29 | 6.6 | 4.7 | 0.9 | 0.4 | 0.1 | 0.3 | 0.01 | |
| F* | Bal. | 30 | 6.6 | 4.8 | 3.0 | 1.0 | 0.5 | 0.8 | 0.11 | |
| G | Bal. | 29 | 6.6 | 4.8 | 0.04 | <0.01 | <0.01 | <0.01 | 0.002 | |
| H* | Bal. | 31 | 4.9 | 5.9 | 0.9 | 0.5 | 0.4 | 0.3 | 0.03 | |
| I* | Bal. | 31 | 5.2 | 4.5 | 1.2 | 0.4 | 0.4 | 0.3 | 0.04 | |
| J | Bal. | 31 | 5.7 | 2.7 | 1.1 | 0.4 | 0.2 | 0.3 | 0.03 | |
| K | Bal. | 31 | 5.0 | 10.0 | 1.0 | 0.4 | 0.4 | 0.3 | 0.03 | |
| L | Bal. | 30 | 5.6 | 8.2 | 1.0 | 0.5 | 0.2 | 0.5 | 0.03 | |
| M | Bal. | 31 | 8.9 | 2.5 | 1.0 | 0.5 | 0.2 | 0.4 | 0.03 | |
| N | Bal. | 31 | 5.1 | 3.1 | 1.2 | 0.3 | 0.4 | 0.1 | 0.02 | |
| O* | Bal. | 33 | 5.6 | 4.5 | 1.0 | 0.4 | 0.2 | 0.3 | 0.03 | |
| P* | Bal. | 30 | 6.9 | 4.8 | <0.05 | 0.4 | 0.3 | 0.4 | 0.03 | |
| Q* | Bal. | 31 | 5.5 | 4.0 | 1.0 | 0.5 | 0.3 | 0.4 | 0.03 | |
| R* | Bal. | 30 | 5.4 | 4.0 | 1.0 | 0.5 | 0.3 | 0.4 | 0.07 | |
| S* | Bal. | 31 | 5.6 | 3.8 | 0.9 | 0.4 | 0.3 | 0.4 | 0.06 | |
| 200** | 99.0 min (Ni + Co) | — | — | 0.1 | 0.2 | 0.2 | — | 0.2 | 0.08 | |
| 400** | 66.5 Ni + Trace Co | — | — | 31.5 | 1.2 | 1.0 | — | 0.2 | 0.2 | |
| 600** | 76.0 | 15.5 | — | 0.2 | 8.0 | 0.5 | — | 0.2 | 0.08 | |
| C-4** | 65.0 | 16.0 | 16.0 | 0.5 max | 3.0 max | 1.0 max | — | 0.08 max | 0.01 max | Ti 0.7 max |
| C-22** | 56.0 | 22.0 | 13.0 | 0.5 max | 3.0 | 0.5 max | — | 0.08 max | 0.01 max | W 3.0<br>V 0.35 max |
| C-276** | 57.0 | 16.0 | 16.0 | 0.5 max | 5.0 | 1.0 max | — | 0.08 max | 0.01 max | W 4.0<br>V 0.35 max |
| C-2000** | 59.0 | 23.0 | 16.0 | 1.6 | 3.0 max | 0.5 max | 0.5 max | 0.08 max | 0.01 max | |
| G-30** | 43.0 | 30.0 | 5.5 | 2.0 | 15.0 | 1.5 max | — | 0.8 max | 0.03 max | Co 5.0 max<br>Nb 0.8<br>W 2.5 max |
| G-35** | 58.0 | 33.2 | 8.1 | 0.3 max | 2.0 max | 0.5 max | 0.4 max | 0.6 max | 0.05 max | W 0.6 max |

*denotes an alloy of this invention
**denotes a nominal composition

The experimental alloys were made by vacuum induction melting (VIM), then electro-slag re-melting (ESR), at a heat size of 13.6 kg. Traces of nickel-magnesium and/or rare earths were added to the VIM furnace charges, to help minimize the sulfur and oxygen contents of the experimental alloys. The ESR ingots were homogenized, hot forged, and hot rolled into sheets of thickness 3.2 mm for test. Surprisingly, three of the alloys (G, K, and L) cracked so badly during forging that they could not be hot rolled into sheets for testing. Those alloys which were successfully rolled to the required test thickness were subjected to annealing trials, to determine (by metallographic means) the most suitable annealing treatments. Fifteen minutes at temperatures between 1121° C. and 1149° C., followed by water quenching were determined to be appropriate, in all cases. The commercial alloys were all tested in the condition sold by the manufacturer, the so-called "mill annealed" condition.

Corrosion tests were performed on samples measuring 25.4×25.4×3.2 mm. Prior to corrosion testing, surfaces of all samples were manually ground using 120 grit papers, to negate any surface layers and defects that might affect corrosion resistance. The tests in sulfuric acid were carried out in glass flask/condenser systems. The tests in sodium hydroxide were carried out in TEFLON systems, since glass is attacked by sodium hydroxide. A time of 96 hours was used for the sulfuric acid tests, with interruptions every 24 hours to enable samples to be weighed, while a duration of 720 hours was used for the sodium hydroxide tests. Two samples of each alloy were tested in each environment, and the results averaged.

In sulfuric acid, the primary mode of degradation is uniform attack, thus average corrosion rates were calculated from weight loss measurements. In sodium hydroxide, the primary mode of degradation is internal attack, which is either a uniform attack or more aggressive form of internal "dealloying" attack. Dealloying generally refers to the leaching of certain elements (for example, molybdenum) from the alloy, which often degrades the mechanical properties as well. The maximum internal attack can only be measured by sectioning the samples and studying them metallographically. The values presented in Table 2 represent measured maximum internal penetration in the alloy cross-section.

A pass/fail criterion of 0.5 mm/y (the generally acknowledged limit for industrial service) was applied to the test results in both environments.

Table 2 reveals that alloys of the present invention corrode at low enough rates in 70% sulfuric acid to be useful industrially at 93° C. and exhibit internal penetration rates that correspond to significantly less than 0.5 mm/y in 50% sodium hydroxide at 121° C. Interestingly, unlike the nickel-chromium-molybdenum alloys with high molybdenum contents (C-4, C-22, C-276, and C-2000), none of the alloys of this invention exhibited a dealloying form of corrosion attack. Alloy C is considered borderline in 70% sulfuric acid at 93° C., suggesting that a copper level of 3.1 wt. % is too low (even though Alloy N, with a similar copper content but higher chromium content, corroded at a lower rate). The preferred copper range of greater than 3.1 wt. % but no more than 6.0 wt. % is based on the results for Alloys C and A, respectively. Alloys K and L, with higher copper contents could not be forged.

The chromium range is based on the results for Alloys A and O (with contents of 27 and 33 wt. %, respectively). The molybdenum range is based on the results for Alloys H and A (with contents of 4.9 and 7.8 wt. %, respectively), and the suggestion of U.S. Pat. No. 6,764,646, which indicates that molybdenum contents below 4.9 wt. % do not provide sufficient resistance to general corrosion of the nickel-chromium-molybdenum-copper alloys. This is important for neutralizing systems containing other chemicals.

Surprisingly, when iron, manganese, aluminum, silicon, and carbon were omitted (Alloy G), the alloy could not be forged. To determine further the influence of iron, Alloy P, with no deliberate iron addition, was melted. The fact that Alloy P was successfully hot forged and hot rolled indicates that it is the presence of manganese, aluminum, silicon, and carbon that is critical to the successful wrought processing of these alloys. In addition, absence of iron in alloy P was not detrimental from a corrosion standpoint as the alloy indicated excellent performance in both corrosive media.

the exceptional performance of the alloys of this invention in 70% sulfuric acid and 50% sodium hydroxide.

Copper (Cu), at levels greater than 3.1 wt. %, but no more than 6.0 wt. %, and in combination with the abovementioned levels of chromium and molybdenum, produces alloys with unusual and unexpected resistance to acids and alkalis, in the form of 70% sulfuric acid at 93° C. and 50% sodium hydroxide at 121° C.

Iron (Fe) is a common impurity in nickel alloys. Iron contents of up to 3.0 wt. % have been found to be acceptable in the alloys of this invention.

Manganese (Mn) is used to minimize sulfur in such alloys, and contents between 0.3 and 1.0 wt. % were found to result in successful alloys (from processing and performance standpoints).

Aluminum (Al) is used to minimize oxygen in such alloys, and contents between 0.1 and 0.5 wt. % were found to result in successful alloys.

Silicon (Si) is not normally required in corrosion-resistant nickel alloys, but is introduced during argon-oxygen decarburization (for those alloys melted in air). A small quantity of silicon (in the range 0.1 to 0.8 wt. %) was found to be essential in the alloys of this invention, to ensure forgeability.

TABLE 2

Corrosion Test Results for Experimental and Commercial Alloys

| Alloy | Corrosion Rate in 70% $H_2SO_4$ at 93° C. in 96 h (mm/y) | Mode of Attack in 50% NaOH at 121° C. in 720 h | Maximum Internal Penetration in 50% NaOH at 121° C. in 720 h (microns) | Comments |
|---|---|---|---|---|
| A* | 0.44 | GC | 10 [equiv. to 0.12 mm/y] | |
| B* | 0.32 | GC | 15 [equiv. to 0.18 mm/y] | |
| C | 0.48 | GC | 15 [equiv. to 0.18 mm/y] | Borderline in $H_2SO_4$ |
| D | 0.64 | GC | 10 [equiv. to 0.12 mm/y] | |
| E* | 0.35 | GC | 11 [equiv. to 0.13 mm/y] | |
| F* | 0.30 | GC | 12 [equiv. to 0.15 mm/y] | |
| G | — | — | — | Unable to Process |
| H* | 0.34 | GC | 20 [equiv. to 0.24 mm/y] | |
| I* | 0.42 | GC | 8 [equiv. to 0.10 mm/y] | |
| J | 1.09 | GC | 10 [equiv. to 0.12 mm/y] | |
| K | — | — | — | Unable to Process |
| L | — | — | — | Unable to Process |
| M | 0.53 | GC | 17 [equiv. to 0.21 mm/y] | |
| N | 0.42 | GC | 15 [equiv. to 0.18 mm/y] | |
| O* | 0.40 | GC | 8 [equiv. to 0.10 mm/y] | |
| P* | 0.40 | GC | 13 [equiv. to 0.16 mm/y] | |
| Q* | 0.39 | GC | 10 [equiv. to 0.12 mm/y] | |
| R* | 0.41 | GC | 10 [equiv. to 0.12 mm/y] | |
| 200 | 2.60 | GC | 13 [equiv. to 0.16 mm/y] | |
| 400 | 2.03 | GC | 14 [equiv. to 0.17 mm/y] | |
| 600 | 7.20 | GC | 13 [equiv. to 0.16 mm/y] | |
| C-4 | 0.94 | Dealloying | 69 [equiv. to 0.84 mm/y] | |
| C-22 | 0.94 | Dealloying | 64 [equiv. to 0.78 mm/y] | |
| C-276 | 0.50 | Dealloying | 58 [equiv. to 0.71 mm/y] | |
| C-2000 | 0.37 | Dealloying | 38 [equiv. to 0.46 mm/y] | Borderline in NaOH |
| G-30 | 0.98 | GC | 8 [equiv. to 0.10 mm/y] | |
| G-35 | 9.13 | GC | 8 [equiv. to 0.10 mm/y] | |

*denotes an alloy of this invention
GC—General Corrosion

The observations regarding the effects of the alloying elements are as follows:

Chromium (Cr) is a primary alloying element, known to improve the performance of nickel alloys in oxidizing acids. It has been shown to provide the desired corrosion resistance to both 70% sulfuric acid and 50% sodium hydroxide in the range 27 to 33 wt. %.

Molybdenum (Mo) is also a primary alloying element, known to enhance the corrosion-resistance of nickel alloys in reducing acids. In the range 4.9 to 7.8 wt. %, it contributes to Likewise, carbon (C) is not normally required in corrosion-resistant nickel alloys, but is introduced during carbon arc melting (for those alloys melted in air). A small quantity of carbon (in the range 0.01 to 0.11 wt. %) was found to be essential in the alloys of this invention, to ensure forgeability.

Traces of magnesium (Mg) and/or rare earth elements are often included in such alloys for control of unwanted elements, for example sulfur and oxygen. Thus, the usual range of up to 0.05 wt. % is preferred for each of these elements in the alloys of this invention.

Nitrogen (N) is easily absorbed by high chromium nickel alloys in the molten state, and it is usual to allow a maximum of 0.13 wt. % of this element in alloys of this kind.

Other impurities that might occur in such alloys, due to contamination from previously-used furnace linings or within the raw charge materials, include cobalt, tungsten, niobium (columbium), titanium, vanadium, tantalum, sulfur, phosphorus, oxygen, and calcium.

Prior art concerning other high-chromium nickel alloys (U.S. Pat. No. 6,740,291, Crook) indicates that impurity levels of cobalt and tungsten in alloys of this kind can be tolerated at levels up to 5 wt. % and 0.65 wt. %, respectively. Furthermore, U.S. Pat. No. 6,740,291 states that the impurities niobium, titanium, vanadium, and tantalum, which promote the formation of nitrides and other second phases, should be held at low levels of less than 0.2 wt. %. The acceptable impurity levels for sulfur (up to 0.015 wt. %), phosphorus (up to 0.03 wt. %), oxygen (up to 0.05 wt. %), and calcium (up to 0.05 wt. %) are also defined in U.S. Pat. No. 6,740,291. These impurity limits are deemed appropriate for the alloys of this invention.

Even though the samples tested were in the form of wrought sheets, the alloys should exhibit comparable properties in other wrought forms, such as plates, bars, tubes, and wires, and in cast and powder metallurgy forms. Also, the alloys of this invention are not limited to applications involving the neutralization of acids and alkalis. Indeed, they might have much broader applications in the chemical process industries and, given their high chromium and the presence of copper, should be useful in resisting metal dusting.

Given a desire to maximize the corrosion resistance of these alloys, while optimizing their microstructural stability (hence ease of wrought processing), it is anticipated that the ideal alloy would comprise 31 wt. % chromium, 5.6 wt. % molybdenum, 3.8 wt. % copper, 1.0 wt. % iron, 0.5 wt. % manganese, 0.3 wt. % aluminum, 0.4 wt. % silicon, and 0.03 to 0.07 wt. % carbon, with a balance of nickel, nitrogen, impurities, and traces of magnesium and the rare earth elements (if used for the control of sulfur and oxygen). In fact, two alloys, Q and R, with this preferred nominal composition have been successfully melted, hot forged and rolled into sheet. As seen from Table 2, both alloys Q and R exhibited excellent corrosion resistance in the selected corrosive media. Moreover, with this aim nominal composition, a production scale heat (13,608 kg.) of alloy S has been melted and rolled successfully, thereby confirming that the alloy has excellent formability. A corresponding range (typical of melt shop practice) would be 30 to 33 wt. % chromium, 5.0 to 6.2 wt. % molybdenum, 3.5 to 4.0 wt. % copper, up to 1.5 wt. % iron, 0.3 to 0.7 wt. % manganese, 0.1 to 0.4 wt. % aluminum, 0.1 to 0.6 wt. % silicon, and 0.02 to 0.10 wt. % carbon, with a balance of nickel, nitrogen, impurities, and traces of magnesium and the rare earths (if used for the control of sulfur and oxygen).

What is claimed is:

1. A nickel-chromium-molybdenum-copper alloy resistant to 70% sulfuric acid at 93° C. and 50% sodium hydroxide at 121° C., consisting essentially of:

30 to 33 wt. % chromium
5.0 to 6.2 wt. % molybdenum
3.5 to 4.0 wt. % copper
Up to 1.5 wt. % iron
0.3 to 0.7 wt. % manganese
0.1 to 0.4 wt. % aluminum
0.1 to 0.6 wt. % silicon
0.02 to 0.10 wt. % carbon
Up to 0.13 wt. % nitrogen
Up to 0.05 wt. % magnesium
Up to 0.05 wt. % rare earth elements
with a balance of nickel and impurities.

2. A nickel-chromium-molybdenum-copper alloy resistant to 70% sulfuric acid at 93° C. and 50% sodium hydroxide at 121° C., consisting essentially of:

31 wt. % chromium
5.6 wt. % molybdenum
3.8 wt. % copper
1.0 wt. % iron
0.5 wt. % manganese
0.4 wt. % silicon
0.3 wt. % aluminum
0.03 to 0.07 wt. % carbon
with a balance of nickel, nitrogen, impurities, and traces of magnesium.

3. A nickel-chromium-molybdenum-copper alloy resistant to 70% sulfuric acid at 93° C. and 50% sodium hydroxide at 121° C., consisting essentially of:

31 wt. % chromium
5.6 wt. % molybdenum
3.8 wt. % copper
1.0 wt. % iron
0.5 wt. % manganese
0.4 wt. % silicon
0.3 wt. % aluminum
0.03 to 0.07 wt. % carbon
with a balance of nickel, nitrogen, impurities, traces of magnesium and the rare earth elements.

* * * * *